US006116593A

United States Patent [19]

Cote et al.

[11] Patent Number: 6,116,593

[45] **Date of Patent: *Sep. 12, 2000**

[54] METHOD AND APPARATUS FOR NON-CONTACT DECELERATION OF FLAT PRODUCTS

[75] Inventors: Kevin Lauren Cote, Durham; Richard Daniel Curley, Dover, both of N.H.

[73] Assignees: Heidelberg Harris, Inc., Dover, N.H.; Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/751,695

[22] Filed: Nov. 18, 1996

[51] Int. Cl.[7] ..... B65H 31/00

[52] U.S. Cl. ..... 271/211; 271/182; 271/82

[58] Field of Search ..... 271/182, 82, 211

[56] References Cited

U.S. PATENT DOCUMENTS

| | | | |
|---|---|---|---|
| 2,610,850 | 9/1952 | Huck | 271/79 |
| 4,132,403 | 1/1979 | Weisbach et al. . | |
| 4,290,595 | 9/1981 | Thunker . | |
| 4,629,175 | 12/1986 | Fischer et al. . | |
| 4,736,941 | 4/1988 | Petersen | 271/277 |
| 5,141,221 | 8/1992 | Mack et al. . | |
| 5,452,886 | 9/1995 | Cote et al. . | |
| 5,794,929 | 8/1998 | Curley et al. | 271/82 X |

FOREIGN PATENT DOCUMENTS

| | | | |
|---|---|---|---|
| 97571 | 4/1988 | Japan | 271/211 |
| 209158 | 7/1992 | Japan | 271/211 |

*Primary Examiner*—Christopher P. Ellis
*Assistant Examiner*—Patrick Mackey
*Attorney, Agent, or Firm*—Burns, Doane, Swecker & Mathis, LLP

[57] ABSTRACT

The present invention relates to a deceleration device for flat products, such as signatures. A deceleration device has a plurality of seizing elements attached thereto for seizing signatures at their respective leading edge while the signatures are emerging from a conveying device. The leading edge of a signature travels on a first path, whereas the trailing edge of the signature travels on a second path, which creates a larger air-drag coefficient on the signature than the first path.

10 Claims, 5 Drawing Sheets

METHOD AND APPARATUS FOR NON-CONTACT DECELERATION OF FLAT PRODUCTS

BACKGROUND OF THE INVENTION

1. Field of the Invention

The present invention relates to a method and apparatus for non-contact deceleration of flat products, such as signatures or the like emerging from a folding apparatus.

2. State of the Art

U.S. Pat. No. 4,132,403 discloses a sheet-transfer apparatus for printing presses. Sheets are transferred from a supply to a continuously rotating receiver drum in a printing press by a transfer drum having at least two angularly spaced grippers. The drum carrying the grippers is rotated at a relatively slow speed, and each of the grippers can be angularly displaced on the transfer drum and relative to the other gripper. Thus, each gripper is accelerated after it has picked up a sheet at a pick-up station, so that when it reaches a transfer station where it passes the sheet off to the receiver drum, it is moving at the same speed as the receiver drum. Thereafter, each gripper is uniformly decelerated, so that when it has returned to the pick-up station, it is moving at the same speed as the sheet at the pick-up station.

U.S. Pat. No. 4,290,595 shows a rotatable advance, or forward, gripper drum. As described therein, a continuously rotatable advance gripper drum assembly is provided for sheet-fed rotary printing presses, and has an advance gripper drum and a gripper bridge movable relative to the drum. The gripper drum assembly includes a crank-driven linkage transmission device disposed on and rotatable with the advance gripper drum, and operatively connected to the gripper bridge for moving the gripper bridge.

U.S. Pat. No. 4,629,175 discloses a method and apparatus for the stream-feeding delivery of sheet-like products coming of a folder. The sheet-like products are initially transported some distance before being caused to overlap. In order to slow down the products for allowing this to take place, and to arrange them in a perfectly regular feeding stream without being damaged, the products are engaged by grippers which are moved along a preferably arcuate path on a support, in the course of which the products are slowed down by the grippers to the speed of a delivery belt whereon the products are then deposited.

U.S. Pat. No. 5,141,221 discloses a deceleration device in the folder of a rotary printing press. Folded products following one behind the other are gripped by decelerable transport devices and conveyed. The oppositely arranged transport devices tracing a path of motion are driven by a planetary gearing. While planetary gears rotate, an instantaneous center describes a cardioid which, via drive brackets, causes the transport devices to possess different speeds during rotation of the planetary gears.

U.S. Pat. No. 5,452,886 discloses a device for slowing down signatures in a folding apparatus. The device provides a plurality of rotary grippers which positively grip signatures exiting a tape-conveyor system in the folding apparatus traveling at a high velocity. A deceleration drum is also provided for slowing down the signatures through a smooth velocity profile. The deceleration drum has a plurality of pivot arms pivotally mounted on a pivot disc rotating about a first axis, the pivot arms being connected to a control disc by a control link, the control disc rotating about a second axis located parallel to and offset from the first axis. The rotary grippers are attached to outward ends of the pivot arms. The rotary grippers grip the leading edges of the signatures as they exit the tape-conveyor system while the trailing edges are still being controlled by the tape-conveyor system. The deceleration drum may alternately be constructed of a cam and linkage system in place of the pivot arm/pivot disk and a control link/control disk mechanism.

In practice, a technical problem has been encountered during deceleration of the signatures in the manner described by the foregoing patents, the disclosures of the '595 '175 '221 and '886 patents being incorporated herein by reference in their entireties. More particularly, the signature path of the trailing edges of the signatures during slow down follow essentially the same path as the leading edges of the signatures. As the paths are essentially identical, only friction due to the signature-buckling can be used to remove kinetic energy from the signatures moving with high speed before being slowed down. If the signature path is imposed on a deceleration drum, the signatures must be stiff enough to resist buckling when the leading edge of a signature is decelerated.

SUMMARY OF THE INVENTION

Having described the state of the art, it is an object of the present invention to use air drag generated in signature conveyance to slow down signatures in a folding apparatus.

A further object of the present invention is to decelerate signatures conveyed at high speeds without marking the signatures.

Another object of the present invention is to absorb the signatures high kinetic energy without the signatures being rubbed against other objects or buckled.

According to exemplary embodiments of the present invention, a deceleration device for flat products, such as signatures or the like, comprises the following features: a deceleration drum; and a plurality of seizing elements attached to said deceleration drum for seizing a signature at its leading edge while said signature emerges from a conveying device, such that a leading edge of said signature travels on a first path, whereas a trailing edge of said signature travels on a second path which creates a larger air drag coefficient on said signature than said first path.

The use of air displacement as a deceleration phenomenon for signatures conveyed at high speeds is very advantageous because of its non-marking characteristic. By having a signature's trailing edge change its orientation upon movement of the deceleration device, the air drag coefficient can be significantly increased. Consequently the air being displaced can absorb much of the signature's kinetic energy without damage to the surface of the signature.

Still further benefits can be obtained in that an air chamber can be assigned to the signature's trailing edge conveying path, in order to achieve a maximum of deceleration by way of entrapping the air to be displaced. Since the signatures emerging from the conveyor tapes only gradually adopt a suitable orientation and generate a large air drag coefficient, the amount of deceleration to be achieved can be significantly increased in the area where said air chamber is located. An increased air drag coefficient can be achieved by having the signature adopt an orientation substantially perpendicular to the trailing edge velocity vector. Since a signature's trailing edge passes the air chamber, the air entrapped within respective portions of the air chamber is forced to be displaced, thus forming a cushion which prevents the signature's surfaces from being marked.

An exemplary air chamber comprises two laterally extending portions, each having a clearance between lateral edges of the signatures. The two laterally extending portions of the air chamber can be adjusted to permit a different volume of entrapped air to escape through respective clearances, whereby different deceleration characteristics can be obtained. The back-portion of the air chamber comprises an air inlet tube through which the volume of air escaping through the clearances is replaced. Thus, a constant volume of entrapped air is maintained in the air chamber, so that an air cushion is formed which provides uniform deceleration of the signatures. Between the lower portion of the air chamber and a signature's leading edge, an air escape zone is formed which allows the entrapped air to escape gradually.

By displacing the air entrapped within the air chamber, the high kinetic energy of the signatures conveyed at high speeds is absorbed without any product-damaging effects.

BRIEF DESCRIPTION OF THE DRAWINGS

The present invention, together with additional objects and advantages thereof, will be best understood from the following description of exemplary embodiments when read in connection with the accompanying drawings, in which.

DETAILED DESCRIPTION OF PREFERRED EMBODIMENTS

Figure 1:
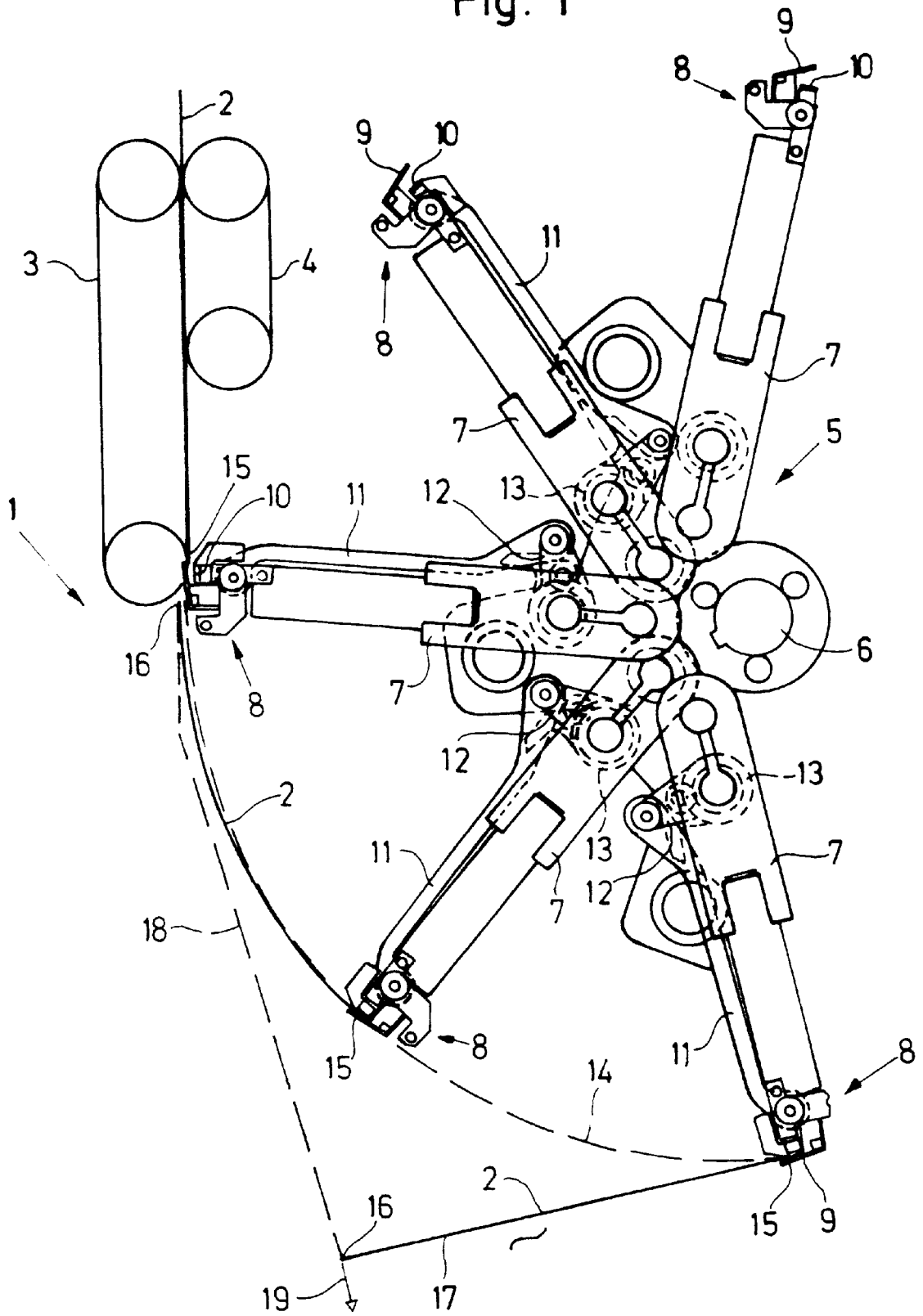
FIG. 1 shows a deceleration device assigned to a conveyor assembly, with a signature's trailing edge traveling a different path as compared to the signature's leading edge.

FIG. 1 shows a deceleration device assigned to a conveyor assembly in accordance with an exemplary embodiment of the present invention, wherein the trailing edges of flat products travel on a different path as compared to the leading edges of the flat products. A delivery device 1 assigned to a folding apparatus, a rotary cross-cutter or the like, includes conveying devices, such as belts 3, 4 for conveying flat products, such as signatures 2. A deceleration drum 5 is assigned to the conveying belts 3, 4 to seize the leading edge 15 of an emerging signature 2.

The deceleration device 5 rotates about a center axis 6 and includes a plurality of rotating arms 7. A seizing element 8 is attached to each of the rotating arms in a manner as described, for example, in U.S. Pat. No. 5,452,886, the disclosure of which is hereby incorporated by reference in its entirety. The seizing elements 8 each include a finger-shaped element 9 as well as a pad element 10 to ensure positive control of the leading edge 15 of the signatures 2. For actuating the signature seizing elements 8, actuating rods 11 are provided, each of which is coupled to an actuating lever 12. By means of the actuating rods 11, the finger-shaped elements 9 of the seizing elements 8 are controlled to ensure the control of a signature's leading edge 15 upon rotation of the respective rotating arm 7 around the center axis 6.

The signatures 2 emerging from the lower end of the conveying belts 3, 4 are seized at their respective leading edges 15. When a seizing element 8 is in control of a signature's leading edge 15, the leading edge 15 substantially follows the path 14 of the finger-shaped elements 9, which extends around the center axis 6 of the deceleration drum 5. However, the signature's trailing edge 16 follows a different path; namely the signature's trailing edge path 18.

Figure 2:
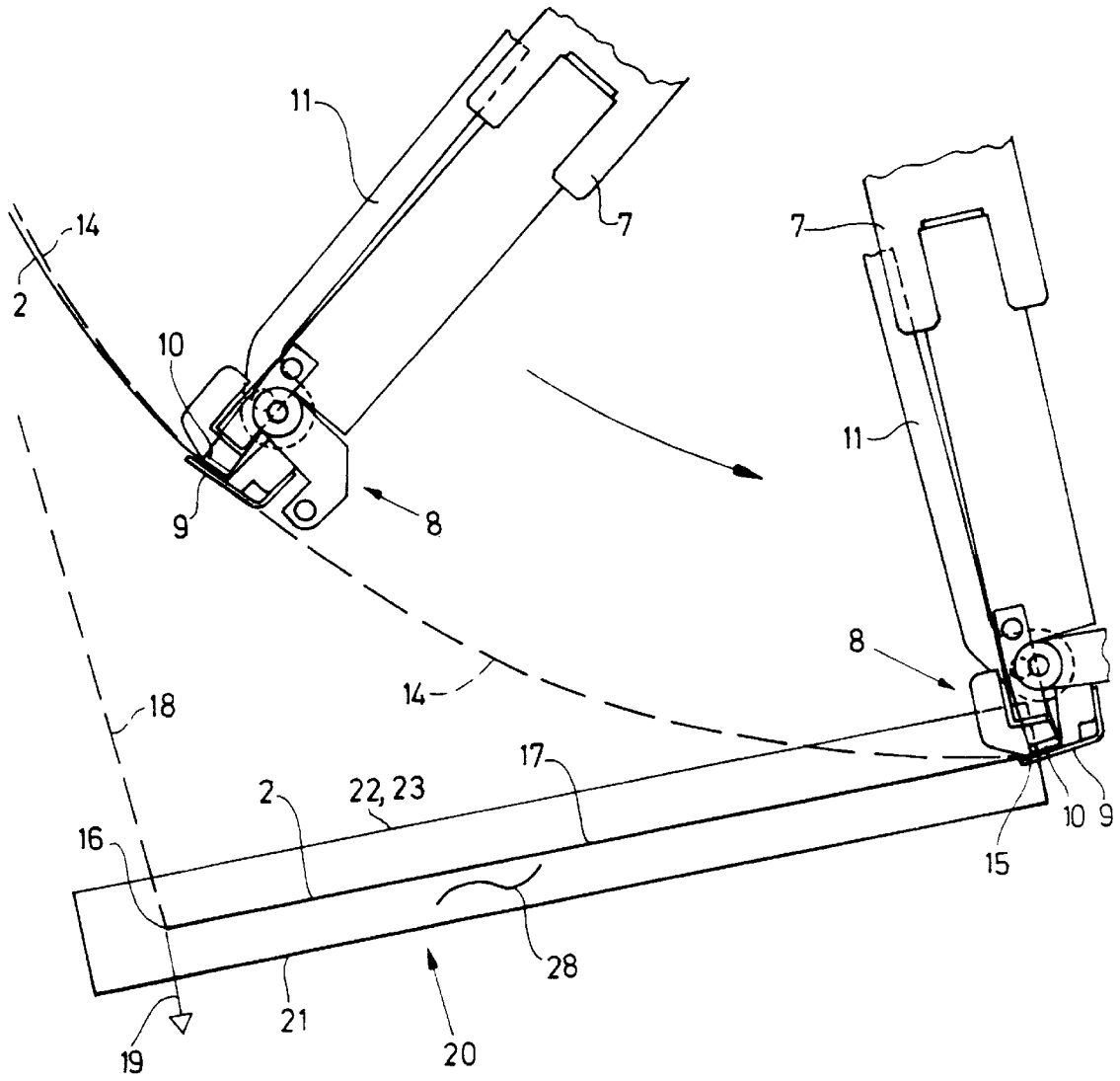
FIG. 2 shows a schematic view of an air chamber assigned to the path of the signature's trailing edge, the trailing edge having an orientation which is perpendicular with respect to the trailing edge velocity vector.
Figure 5:
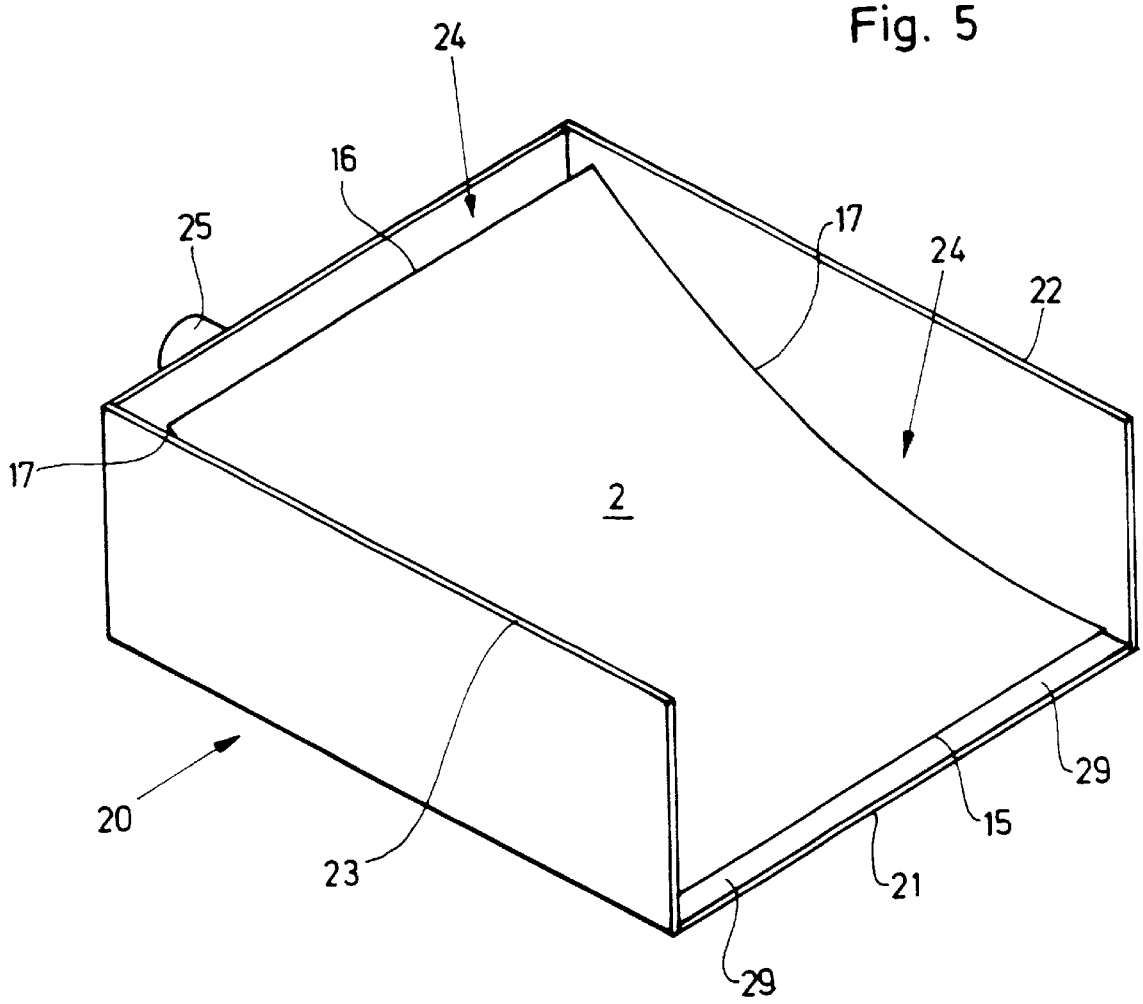

After a seizing element 8 has seized a respective signature 2 at its leading edge 15, the rotating arm 7 starts to decelerate, until the signature, (i.e., having an initial speed of approximately 3000 ft/min. in an exemplary embodiment), is slowed down (e.g., to approximately 500 ft/min in an exemplary embodiment). The signature's respective trailing edge 16, at the beginning of the deceleration phase, follows the seizing element path 14 but then gradually deviates from the seizing element path 14 to adopt a trailing edge path 18 to which an air chamber 20 is assigned, as shown in FIGS. 2 and 5. The signatures 2 can, for example, adopt an orientation extending perpendicularly to a velocity vector 19, as shown in FIG. 1.

The air chamber 20 is schematically illustrated in FIG. 2. The air chamber 20 includes side portions 22, 23, a lower inside 21 and an upper portion at its front end, where a signature's leading edge 15 is shown. The side portions 22, 23 are of relatively low overall height but can extend arcuately in an upward direction to further influence the air displacement phenomenon. As shown schematically in FIG. 2, the signature's trailing edge 16 has followed the trailing edge path 18 in the direction indicated by the velocity vector 19.

Thus, the signature 2 has adopted a horizontal orientation and has entrapped a volume of air in a zone of displacement 28. The displacement of air substantially begins after the seizing elements 8 have seized a signature 2 from the conveying belts 3, 4, and the trailing edge 16 deviates from the seizing 10 element path 14 to adopt a different path 18. Upon leaving the seizing element path 14, the air drag coefficient of the respective signature 2 increases significantly, thus causing the surrounding air to be displaced. The displacement of air contributes to the decrease of kinetic energy of the signature 2 to be decelerated. The displacement of air is limited when side portions 22, 23 of the air chamber 20 extend to a higher level as compared to the exemplary embodiment illustrated in FIG. 2.

Figure 3:
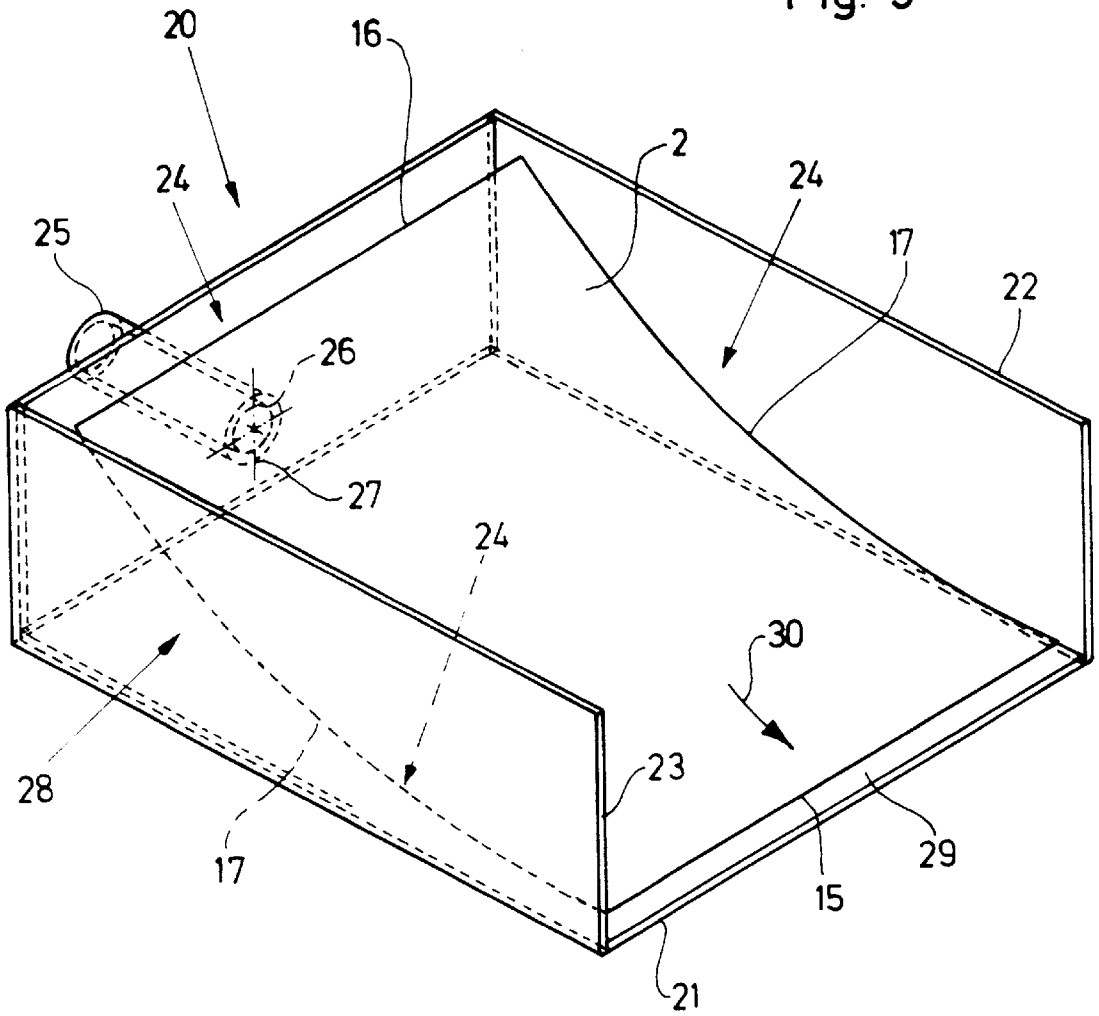
FIG. 3 shows a signature diving into the air chamber having clearances and air escape zones.

FIG. 3 shows a modified air chamber according to an alternate embodiment of the present invention. The product to be decelerated in a manner which prevents any marking and which avoids contact with any stationary object, is shown in an inclined position within the air chamber 20.

The signature's leading edge 14 is seized by seizing elements 8 which are not shown in detail in FIG. 3. The signature's trailing edge 16 and its lateral edges 17, in conjunction with the side portions 22, 23 of the air chamber 20, form clearances 24 through which the air entrapped in the chamber 20 can escape.

The air entrapped in the air chamber 20 is slightly compressed to form an air cushion which supports the lower surface of the signature 2. Since the air entrapped below the signature 2 is displaced via clearances 24 located between the signature's lateral edges 17 and its trailing edge 16, and additionally can pass via an air-escape zone 29, an air supply is provided to keep the volume of air at a constant level.

For this purpose an air-inlet tube 25 is assigned to the back-portion of the air chamber 20. Through an orifice in the tube 25, fresh air is supplied to the zone of displacement 28 to prevent the lower surface of the signature 2 from contacting the lower inside 21 of the air chamber 20. The aforementioned orifice is provided at a certain level 27 with respect to the lower inside 21 of the air chamber 20. Thus, a constant replacement of air is maintained to provide a uniform cushion of air.

By forcing the air through the restrained clearances 24 and the air-escape zone 29, the kinetic energy of a signature 2 is reduced significantly. This effect causes the signatures 2 to slow down and is very beneficial because of its non-marking characteristic. Any contact of the signatures 2 with stationary objects is thus avoided. A reduction of kinetic energy of the signatures 2 through deformation of the signatures is also avoided. The avoidance of such deformation is significant, as such deformation can cause damage to the signatures, particularly when very light and thin products are involved.

Figure 4:
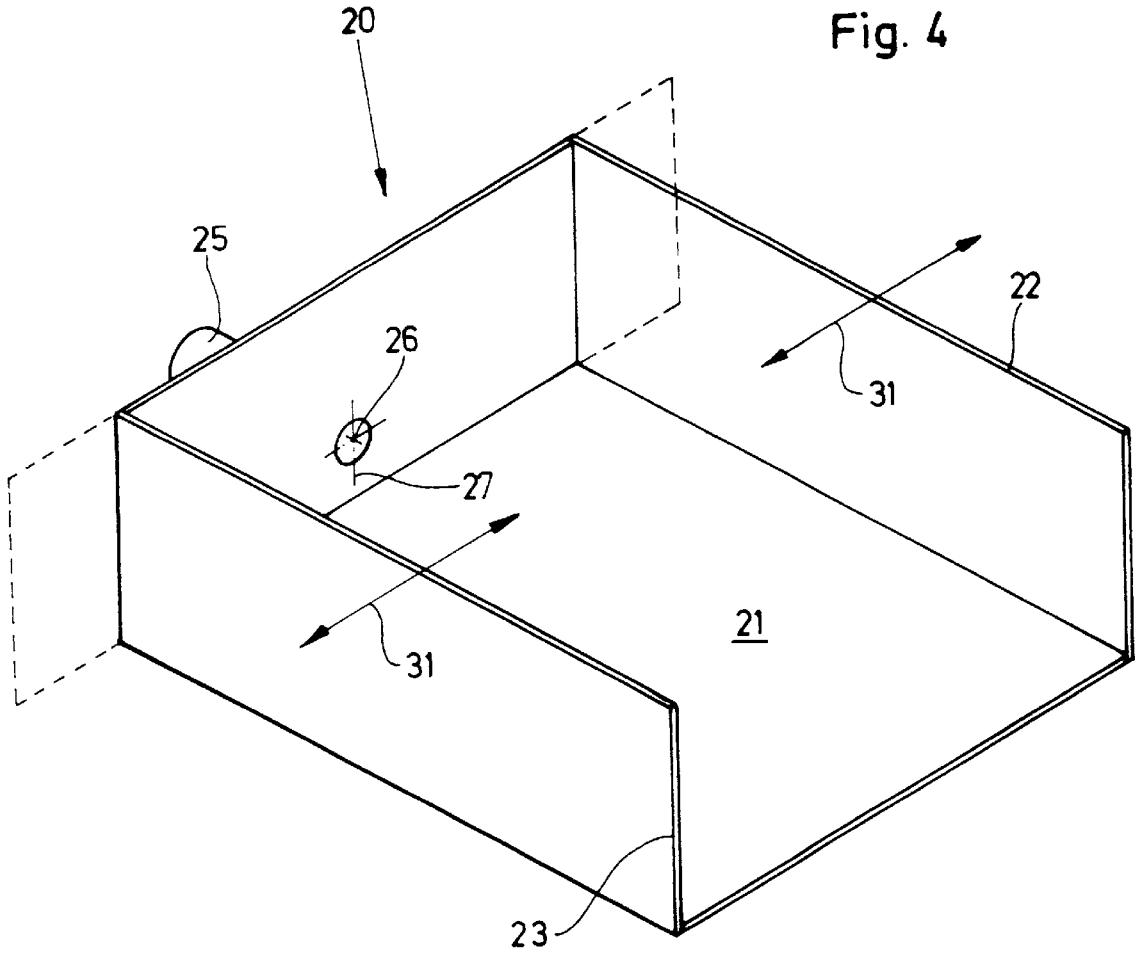
FIGS. 4 and 5 show the air chamber without a signature and with a signature, the lateral and trailing edges of which form clearances with the rims of the air chamber.

As shown in FIG. 4, the amount of restraint of the clearance can be controlled by adjusting the clearance between the lateral edges 17 of the signature 2 and the side portions 22, 23, and by adjusting clearance between the trailing edge and the back-portion of the air chamber 20. For example, the adjustment of the side portions 22, 23 of the air chamber 20 is achieved by rendering the side portions movable and thereby adjustable, as indicated by arrows 31 in FIG. 4. The adjustment can be carried out manually or by means of a spindle drive via electric servomotors, as will be appreciated by a person skilled in the art. Further, a change in the format of the signatures 2 can be compensated by lateral shifting and adjusting of the side portions 22, 23, and/or the back-portion, thus varying the width and/or length of the clearances 24 through which the entrapped air escapes. This provides control of the volume of air entrapped in the chamber 20, which is displaced via the clearances 24. Thus, the absorption of the signature's kinetic energy can be adjusted in accordance with an exemplary embodiment of the present invention.

An exemplary air chamber 20 includes a lower inside 21, a back-portion having an air-inlet tube 25 assigned thereto, as well as two side portions 22, 23. The side portions 22, 23 can have a rectangular shape, as shown herein. In an alternate embodiment, side portions 22, 23 can be constructed with an arcuate outer contour which extends upwardly into the path 18 of the signature's trailing edge 16, so that the deceleration effect derived from the displacement of entrapped air will act on the signature 2 at an earlier point in time. Such a feature provides a gradual and very smooth slow-down of the signatures 2. The side-portions 22, 23, and/or any other portion of the air chamber 20 can be made of plastics, plexiglass, metal or the like.

It will be appreciated by those skilled in the art that although only one air-inlet tube 25 is shown in FIG. 4, a plurality of such tubes can be arranged in spaced apart relation at the back-portion of the air chamber 20 to provide a desired (e.g., uniform) distribution of air.

FIG. 5 shows a signature 2 to be decelerated as it dives into the air chamber 20. Between the signature's leading edge 15 and the front portion of the lower inside 21 of the air chamber 20, an air-escape zone 29 is formed. In an exemplary embodiment, the cross-section of zone 29 can be minimized to prevent an undesired high volume of air from escaping via the air escape zone 29, as compared to the clearances 24 mentioned before.

As can be appreciated from FIG. 5, the signature's trailing edge 16 has not reached the bottom of the air chamber 20. It forces, by its kinetic energy, the volume of air entrapped below through the clearances 24 between the signature's lateral edges 17 and the inner portions of the left and right sides 22, 23 of the air chamber 20, between the back-portion of the air chamber and the trailing edge, and through the air escape zone 29. As mentioned before, the volume of air is replaced through the air-inlet tube 25, so that a volume of air exists to be displaced by the following decelerating signature 2.

It will be appreciated by those skilled in the art that the present invention can be embodied in other specific forms without departing from the spirit or essential characteristics thereof. The presently disclosed embodiments are, therefore, considered in all respects to be illustrative and not restricted. The scope of the invention is indicated by the appended claims rather than the foregoing description, and all changes that come within the meaning and range and equivalence thereof are intended to be embraced therein.

What is claimed is:

1. Deceleration device for flat products, comprising:

a deceleration drum;

a plurality of seizing elements attached to said deceleration drum for seizing a flat product at its leading edge while said flat product emerges from a conveying device, such that the leading edge of the flat product travels on a first path, whereas a trailing edge of said flat product travels on a second path;

an air chamber assigned to the second path for entrapping air to create a larger air drag coefficient on said flat product than said first path; and wherein said second path is configured such that said flat product, upon movement passes said air chamber in which supplied air is entrapped.

2. Deceleration device according to claim 1, wherein said second path is configured such that during travel along said second path in the direction of said air chamber, the trailing edge of the flat product increasingly displaces air.

3. Deceleration device according to claim 1, wherein the first path and the second path are configured such that the leading edge and the trailing edge, upon movement, adopt an orientation perpendicular to a direction of their velocity vector.

4. Deceleration device according to claim 1, wherein said air chamber further comprises:

two side portions, each having a clearance between lateral edges of said flat product.

5. Deceleration device according to claim 1, wherein said air chamber further comprises:

a back-portion having an air inlet provided therein, the back-portion having a clearance with respect to the trailing edge of the flat product.

6. Deceleration device according to claim 1, wherein said air chamber further includes:

a lower inside portion located in said air chamber to provide an air escape zone below the leading edge of said flat product.

7. Deceleration device according to claim 1, wherein said air chamber entraps a volume of air.

8. Deceleration device according to claim 7, wherein the air chamber further includes:

clearances through which the entrapped volume of air escapes such that an air escape zone of the chamber absorbs kinetic energy of said flat product.

9. Deceleration device according to claim 1, wherein said air chamber further includes:

a air-inlet tube which replaces a cushion of air formed in said air chamber.

10. Method of conveying flat products, comprising the steps of:

seizing a flat product at its leading edge while said flat product emerges from a conveying device;

establishing a first path of travel for said leading edge; and establishing a second path, wherein the second path is configured such that said flat product passes an air chamber in which supplied air is entrapped, of travel for a trailing edge of said flat product, wherein second path creates a larger air drag coefficient on said flat product than said first path.

* * * * *